US006824013B2

(12) United States Patent
Harrison et al.

(10) Patent No.: US 6,824,013 B2
(45) Date of Patent: Nov. 30, 2004

(54) INTEGRATED CAP FOR UPRIGHT WATER BOTTLE COOLERS

(76) Inventors: Howard R. Harrison, c/o HB Innovation Ltd., 2085 Hurontario Street, Suite 300, Mississauga, Ontario (CA), L5A 4G1; Jeffrey R. Brown, c/o HB Innovation Ltd., 2085 Hurontario Street, Suite 300, Mississauga, Ontario (CA), L5A 4G1

( * ) Notice: Subject to any disclaimer, the term of this patent is extended or adjusted under 35 U.S.C. 154(b) by 0 days.

(21) Appl. No.: 10/204,902

(22) PCT Filed: Feb. 23, 2001

(86) PCT No.: PCT/CA01/00220

§ 371 (c)(1),
(2), (4) Date: Dec. 23, 2002

(87) PCT Pub. No.: WO01/62659

PCT Pub. Date: Aug. 30, 2001

(65) Prior Publication Data

US 2003/0106907 A1 Jun. 12, 2003

Related U.S. Application Data

(60) Provisional application No. 60/185,105, filed on Feb. 25, 2000.

(51) Int. Cl.[7] ..... B67D 5/40

(52) U.S. Cl. ..... 222/66; 222/146.6; 222/383.1

(58) Field of Search ..... 222/63, 66, 146.6, 222/333, 383.1, 383.2; 62/3.64, 394, 395

(56) References Cited

U.S. PATENT DOCUMENTS

| | | | | |
|---|---|---|---|---|
| 2,413,710 A | * | 1/1947 | Jason | 222/333 |
| 4,174,743 A | * | 11/1979 | Beny et al. | 222/400.8 |
| 4,987,746 A | * | 1/1991 | Roberts | 62/137 |
| 5,469,708 A | * | 11/1995 | Harrison et al. | 62/3.64 |
| 5,540,355 A | * | 7/1996 | Hancock et al. | 222/146.6 |
| 5,558,256 A | * | 9/1996 | Miller et al. | 222/63 |
| 5,638,991 A | * | 6/1997 | Todden et al. | 222/146.1 |

* cited by examiner

*Primary Examiner*—Kenneth Bomberg
(74) *Attorney, Agent, or Firm*—David J. Heller; Ridout & Maybee

(57) ABSTRACT

A cooler and dispenser for use with upright water bottles operates to (1) pump chilled water from a vertical bottle through a top opening, (2) filter the air that is drawn in to replace the water, (3) and provide the user with an indication of the level in the bottle. The dispenser cap is designed to fit snugly over the top of standard 3.0 and 5.0 gallon refillable water bottles in the vertical orientation. A small pump in the dispenser cap draws water from the bottom of the bottle and dispenses it through a tube that extends past the side of the bottle. The vacuum created within the bottle during the pumping process draws air in through a filter that keeps foreign particles from entering the bottle. Further, the air-flow through the filter is constricted so as to ensure that a partial vacuum exists even after the pump has been turned off, and this draws residual water back through the delivery tube thereby preventing drips. The dispenser cap also contains a fluid level indicator that is connected to sensors mounted on the water draw tube.

19 Claims, 8 Drawing Sheets

INTEGRATED CAP FOR UPRIGHT WATER BOTTLE COOLERS

CROSS-REFERENCED TO RELATED APPLICATIONS

This application is a 371 of PCT application number PCT/CA01/00220 and claims priority from U.S. patent application Ser. No. 60/185,105 filed Feb. 25, 2000.

BACKGROUND OF THE INVENTION

1. Field of the Invention

This invention relates to a water cooler and dispensing device that allows standard 3.0 and 5.0 gallon refillable water bottles to remain vertical and upright, rather than inverted, in a completely enclosed, chilled, and insulated container. This configuration precludes the requirement to invert the bottle before placing it on a "traditional" cooler, and it allows the cooler to be much more compact especially when it is chilled using thermoelectric technology.

The dispenser cap dispenses water from the top of the bottle and provides a fluid level indicator since the bottle is enclosed in an insulated container and cannot be seen. The entire bottle is chilled to impede bacterial growth, and air entering the bottle is filtered to prevent foreign particles from contacting the water. In the preferred embodiment a countertop water cooler for 3.0 gallon bottles is small enough to be placed on a kitchen counter and under the overhead housings.

2. Acknowledgement of Prior Art

Water coolers for domestic use have become relatively commonplace and frequently may be floor standing or counter top models which are adapted to receive a large cylindrical water bottle containing, say, 3.0 or 5.0 gallons of liquid. Such cylindrical water bottles must be lifted, positioned and tipped into a neck down position. The bottle top must open downwards so that water may be drained into a chilled reservoir and then dispensed through a spigot located below the reservoir. The water bottles are unwieldy and difficult to handle, and water is frequently spilt while fitting the water bottle into place.

The bottles must be inverted on top of water coolers in order to allow the water to flow out the neck, now at the bottom, and into a reservoir. The water is "held" in place by the vacuum that forms at the top of the inverted bottle, until such time as a reduced level in the reservoir allows more air into the bottle. This reduces the vacuum and allows more water to flow into the reservoir. Typical applications include office or home water coolers where the user lifts and inverts a 3.0 or 5.0 gallon bottle on top of the water cooler. Several other capacities and shapes of bottles are available, but the general principle remains the same.

There are several drawbacks to the current approach. The bottle is not only heavy, but also very awkward to invert once lifted. The entire water cooler I bottle assembly is very large and space consuming, usually requiring a floor stand configuration. Counter top configurations are available, however the bottle must be inverted at an even greater height, and the overall height once the bottle is in place prohibits the unit from being placed under the overhead housings.

The water bottle, once placed on the water cooler, remains exposed to the usually warm surroundings, leaving the water susceptible to bacterial growth as the drained water is displaced with potentially contaminated room air. Also, the water does not actually drain immediately into the user's cup (or other container) but rather drains into a reservoir to be chilled prior to use. Users are advised that the reservoir should be cleaned on a regular basis, but this rarely occurs. Hence the reservoir is also susceptible to contamination over time. Furthermore, the limited size of the reservoir determines the amount of chilled water that may be dispensed at any one time. Subsequent users must wait for the next "batch" of cold water to be chilled in the reservoir.

Rather than address these larger issues, several inventors have focussed on improving the chilling system used in the "traditional" inverted bottle design. As an example, several recent patents suggest the use of thermoelectric modules rather than compressor based refrigeration to cool the reservoir. U.S. Pat. No. 6,119,462 issued Sep. 19, 2000 to Busick and Burrows (assigned to Oasis Corporation) teaches an inverted bottle mounted on top of a reservoir, and an improved method of cooling the reservoir which primarily amounts to an improved method of removing heat from the thermoelectric module which in turn removes heat from water contained in the reservoir. Several other Patents, as listed below, use the same basic "traditional" design and focus on the efficiency and effectiveness of the underlying thermoelectric components.

| | | | |
|---|---|---|---|
| U.S.A. | 6,003,318 | Dec. 11, 1999 | Busick, Burrows |
| U.S.A. | 5,560,211 | Oct. 1, 1996 | Parker |
| U.S.A. | 5,501,077 | Mar. 26, 1996 | Spence, Clark, et al |
| U.S.A. | 5,072,590 | Dec. 17, 1991 | Burrows |

Some of these Patents, for example '211, use the dual cool/heat capabilities of a thermoelectric module to first cool to form ice and then heat to release the ice and allow it to float to the top of the water reservoir. This approach is novel, however the ice, when formed on the conductor plate, does not transfer heat efficiently. Also, the heat required to release the ice from the conductor plate detracts from the overall efficiency of the water cooler. The concern over efficiency has recently come to light with the introduction of Energy Star efficiency standards for water coolers from the Environmental Protection Agency.

While these developments may function as designed, they still exhibit the fundamental problems associated with a "traditional" water cooler. The bottle must be lifted and inverted on top of the cooler, there is an "open" bottle of potentially warm and bacterially friendly water on top of the cooler, and the design occupies a great deal of space Still other inventors have tried to address certain non-cooling aspects of the "traditional" water cooler design. Prior art includes U.S. Pat. No. 6,098,844 issued Aug. 8, 2000 to Nicolle, which suggests the use of water bags rather than inverted bottles on top of the cooler, and U.S. Pat. No. 5,425,614 issued Jun. 20, 1995 to Perussi and Perussi, which suggests the use of a bottle lifting and inverting apparatus to ease the task of placing the bottle on top of the cooler. Two other Patents, U.S. Pat. No. 5,540,355 issued Jun. 30, 1996 to Hancock, Mackay, et al (assigned to Water Chef) and U.S. Pat. No. 5,495,725 issued Mar. 5, 1996 to Middlemiss both suggest that the bottle be left in the upright position, thereby precluding the need to invert the bottle. Both of these designs use a pump to move the water to an external reservoir. In particular, '725 uses an air pump to pressurize the water bottle thus pushing the water out. This approach will work, however it does not provide positive flow control since water will continue to flow, after the pump is turned off, until the pressure subsides, and it does require an hermetic seal between pump and bottle to function properly.

Several "spill proof" cap designs have been disclosed, for example U.S. Pat. No. 4,534,484 issued Aug. 13, 1985 to Deland. While these patents may address specific issues, they do not resolve all of the problems associated with "traditional" water coolers.

U.S. Pat. No. 5,469,708 issued Nov. 25, 1995 to Harrison and Brown teaches an efficient means to cool bottled water through intimate thermal contact with a thermoelectrically cooled cold saddle, and an effective means to control condensation between the water bottle and the cold saddle. In this design the entire bottle of water is chilled with no requirement for an external reservoir that needs to be cleaned on a regular basis. In "traditional" water cooler design terms the bottle becomes a very large capacity reservoir that is automatically replaced each time the water bottle is changed.

It is an object of the present invention to provide a means for dispensing water from a water bottle which may be operated with the bottle in an upright position for ease of handling of the water bottle.

It is a further object of the present invention to provide a means for dispensing water from a water bottle and which is compact in size enabling it to be positioned in relatively small spaces, such as on a counter under cupboards.

It is yet another object of the present invention to integrate a dispensing function and a filtration mechanism for lessening the potential for contamination of the water in the bottle as air flows into the bottle to replace dispensed water.

It is a further object of the present invention to provide a water cooler and dispenser which encloses the water bottle within an insulated housing in order to prevent unwanted heating of the water stored within the water bottle.

It is a further object of the present invention to provide a water cooler and dispenser which combines both functions in a simple, compact and highly efficient unit.

SUMMARY OF THE INVENTION

This invention relates a cooler and dispenser for use with a water bottle. The cooler and dispenser comprises a dispenser cap having a cap housing adapted to operatively engage the neck of the water bottle. A pump is mounted within the cap housing in fluid connection with the interior of the water bottle and with a delivery tube. The cap housing also houses an air inlet tube having a first end in fluid connection with the interior of the bottle and a second end in fluid connection with the air, and an air filter is operatively connected to the second end of the air inlet tube. An actuating means is operatively connected to the pump to selectively operate the pump to draw water from the water bottle into the delivery tube. A thermally conductive cold saddle is provided and configured for intimate supporting contact with the bottom and a selected portion of the sides of the water bottle in order to withdraw heat from the water contained in the water bottle. A housing retainingly engages the dispenser cap, the cold saddle, and the water bottle. The housing has at least one opening to permit the delivery tube and the actuating means to extend therethrough, and at least one other to permit the venting of the heat from the cold saddle. An opening in the housing also permits the through passage of an electrical power supply to the cold saddle and the pump. An indicator light, visible through an opening in the housing is also provided. The indicator light is operatively connected to a control circuit, which in turn is operatively connected to a water level sensor, whereby the indicator light emits a first signal when power is applied to the cooler and dispenser, and a second signal when the fluid level in the water bottle falls below the threshold level.

A dispenser cap is provided for use with a bottle for fluids. The dispenser cap comprises a cap housing adapted to operatively engage a neck of the bottle. A pump is mounted within the cap housing in fluid connection with the interior of the bottle and with a delivery tube. An air inlet means is provided in fluid connection with the interior of the bottle and with the air.

BRIEF DESCRIPTION OF THE DRAWINGS

Embodiments of the invention will now be described by way of example with reference to the drawings in which.

DETAILED DESCRIPTION OF A PREFERRED EMBODIMENT

Figure 1:
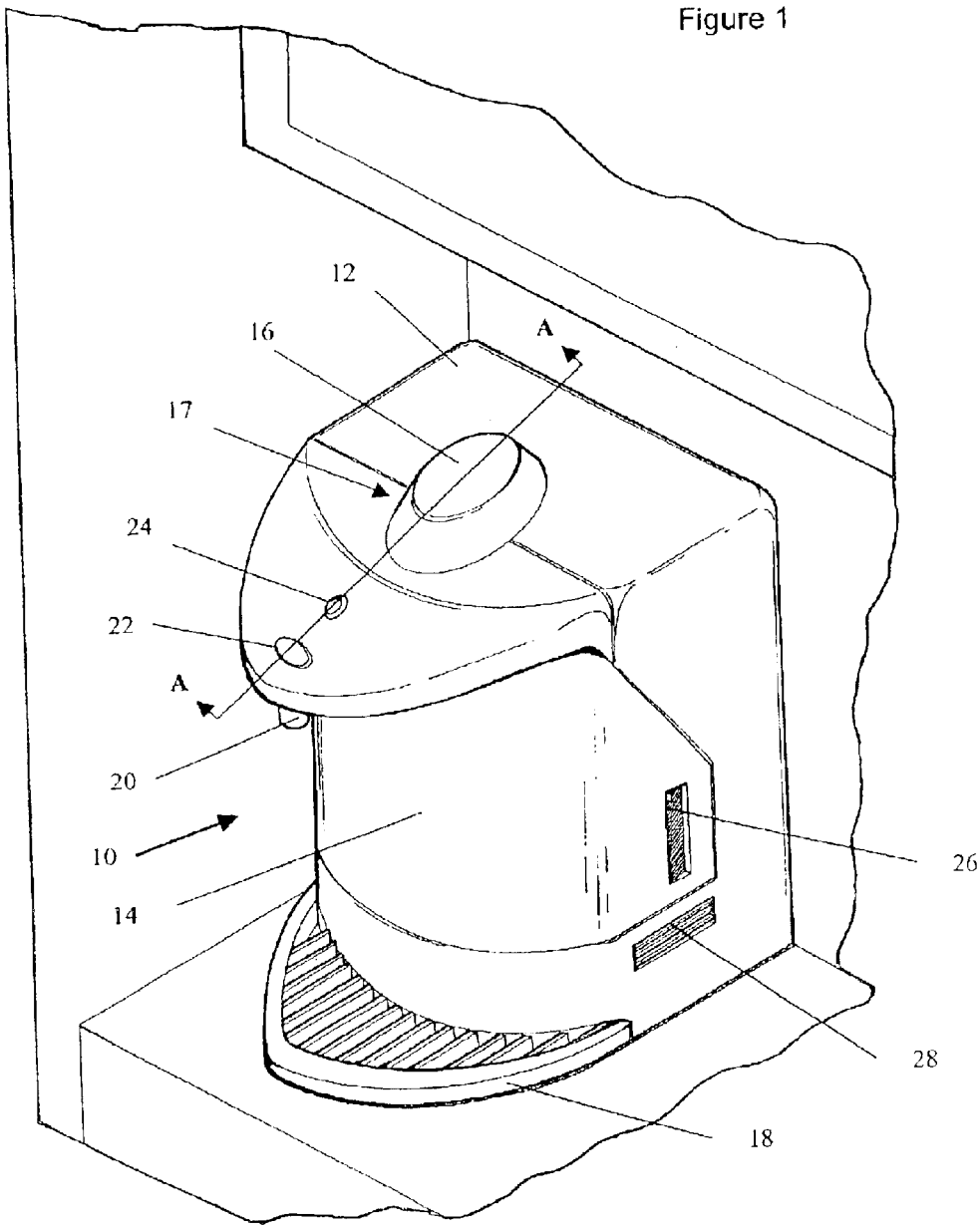
FIG. 1 is a perspective view of the water cooler and dispenser according to the present invention and located in place on a counter top and underneath the overhead housings.

The water cooler and dispenser of the present invention allows water or any other fluid to be easily dispensed from the open top of an upright bottle. Although reference is made to water throughout the following description, it should be understood that the reference to water is by way of example and to identify the preferred use of the device known to the inventors at this time. The cooler and dispenser of the present invention and the dispenser cap are believed to have application to the dispensing of a wide variety of other fluids.

The dispenser cap assembly fits easily on the top opening of a water bottle and contains a small pump. The fluid is directed far enough to the side of the bottle so that the expelled fluid can easily fall into a glass or other container. Other functions have been built into the dispenser cap including a level indicator to notify the user when the bottle is close to being empty, and an incoming air filter to prevent surrounding air contaminants from being "sucked" into the water bottle as air rushes in to replace the pumped water. Thus, the dispenser cap allows water bottles to be left in their upright (or top opening) orientation rather than requiring the user to invert the bottles prior to use. The water bottle may be completely enclosed in a chilled, compact container that may be small enough to be placed on a counter or table top. The container and/or the bottle itself may be chilled through various means including traditional compressor technology with a variety of refrigerants, thermoelectric heat pumps, ice blocks, or any other cooling method.

The pump in the dispenser cap is adapted to draw water from the bottom, or coldest area in the water bottle, by means of a water draw tube. This takes advantage of temperature gradients within the bottle, especially if the bottom of the bottle is being chilled directly. The length of the water draw tube may be fixed or adaptable for slight variations in one size of water bottle, or adjustable to allow use over a wide range of water bottle sizes.

The pump is controlled by an actuating means which can be a simple on/off switch. The actuating means can be conveniently located for use with a cooler and dispenser by allowing the actuating means to protrude through an opening in the housing thereof. The water is directed through a water delivery tube that extends past the edge of the water bottle to facilitate filling of containers. Also, the delivery tube may be fashioned to protrude through an opening in the housing of the water cooler and dispenser if the dispenser cap is deployed in such a system.

The dispenser cap also contains an indicator that alerts the user when the water within the bottle falls below a certain threshold level. This indicator is required in designs where the water bottle is "hidden" within a fully enclosed opaque housing container and cannot be seen by the user. A water level sensor is mounted on the water draw tube with integral connecting wires leading back to the control circuit. The circuitry has been designed to accurately and immediately detect when the water level drops below the sensors while preventing any substantial or harmful electrical currents from ever entering the water bottle. The control circuit causes the indicator to emit a first signal when power is applied to the cooler and dispenser, and a second signal when the fluid level in the water bottle falls below the threshold level. It is preferred to use an LED as an indicator, which may, for example, remain green to indicate that the system is receiving power and working with a surplus of water and then change to red when the water falls below the threshold level.

The dispenser cap contains an air filter to filter incoming air before it enters the water bottle. Air will automatically be drawn into the bottle as water is pumped out; the filter is simply placed in the path of this incoming air. Cool air is drawn in from within the housing to minimize the impact on the water temperature. The primary purpose of the air filter is to prevent air borne contaminants from entering the water bottle. The air filter is adapted for easy removal and replacement in much the same manner as a user would replace a battery.

The power supply to the dispenser cap may be obtained through a simple power plug connection at the back of the cap housing. In instances where the dispenser cap is used in conjunction with a cold saddle and cooler and dispenser housing, the power connection can be fashioned to mate with a power receptacle in the housing of the water cooler, ensuring that the electric connection is made as the user places the dispenser cap into an operatively engaged position on the neck of the bottle. This power plug design also allows the dispenser cap to be used external to the water cooler and dispenser in conjunction with a variety of upright bottles. It is possible to use 12 volt DC power for all components within the dispenser cap in order to ensure that the dispenser cap has portable applications.

The dispenser cap is completely modular in nature. It can be used alone operatively engaged to a water bottle to dispense water and prevent airborne contaminants from reaching the remaining water supply when air flows into the bottle to replace the dispensed water.

The modular nature of the dispenser cap is uniquely adapted for incorporation into a water cooler and dispenser. The dispenser cap can be easily removed from the water bottle and the water cooler for cleaning and servicing, and the water draw and dispensing tubes may be further removed for cleaning or replacement. One of the most important advantages of the present invention is that the dispenser cap comprises almost all of the moving parts in the cooler and dispenser. By removing and replacing the dispenser cap, almost all of the moving parts in a thermoelectric water cooler can be removed and repaired without affecting the rest of the water cooler. This is particularly useful to water suppliers who might use the dispenser cap on their water delivery routes since the assembly can be quickly exchanged and returned for repair without necessitating the removal of the entire water cooler and dispenser unit. FIG. 1 shows water cooler and dispenser 10 in place on a kitchen counter and under the overhead cabinets. The water cooler and dispenser 10 is comprised of housing 12, which has a front cover 14. The housing 12 retainingly engages the cap housing 16, and additionally has a drip tray 18. Water is dispensed through delivery tube 20, a portion of which can be seen extending through an opening in the front cover 14 of the housing 12. The actuating means 22 for the pump also extends through an opening in the front cover 14 in the housing 12. A user would recognize the actuating means 22 as being a water dispensing button.

In the preferred embodiment of the water cooler and dispenser, the indicator is an LED indicator light 24 which would remain lit at all times when the water cooler and dispenser 10 is operating. The indicator light 24 will be green so long as power is flowing through the water cooler and dispenser 10 and whenever the water level is above a certain threshold. The indicator light 24 will turn red when the water level is below the same threshold. This will alert the user that the water supply is low and that it is time to acquire another water bottle prior to running out of drinking water.

The front cover 14 of the housing 12 may be removed by pulling it directly forward with the aid of pull recesses 26 which are located on both sides of the front cover 14. In the preferred embodiment openings 28 are on either side of the housing 12 to allow air to flow through housing 12 while still allowing the water cooler and dispenser 10 to be placed against a back wall, in order to conserve counter space.

The drip tray 18 may also be removed for easy draining and cleaning. The drip tray 18 may become an excellent platform for marketing and branding purposes since it is removable and the design can be modified without affecting the remainder of the water cooler and dispenser.

Figure 2:
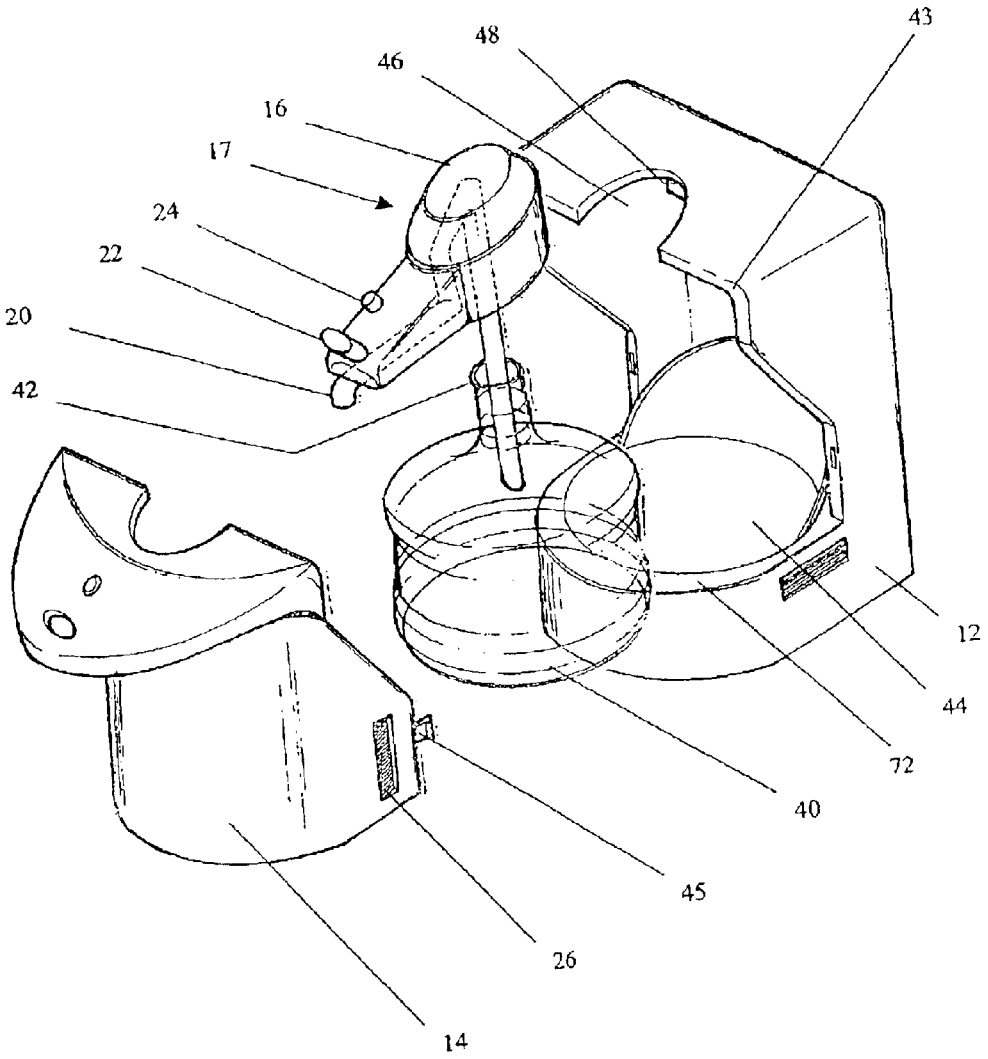
FIG. 2 is an exploded view of the water cooler and dispenser showing all of the major components including the dispenser cap.

In the exploded view shown in FIG. 2, the front cover 14 has been removed to show the water bottle 40 in the upright position. Specifically, the neck of the water bottle is directed upward and the opening 42 in the neck is located at the top of the bottle 40 when in the operating position.

It is advantageous to provide insulation 43 on the inside walls of the housing 12. This presence of insulation will help to maintain the temperature of the water in the water bottle 40 by lessening the warming which would otherwise result from ambient conditions. The insulation is preferably continuous throughout housing 12, including on the inner surface of the front cover 14 and on the floor of the housing 72.

A new water bottle 40 may be installed in the water cooler and dispenser 10 by first placing the cap housing 16 into operative engagement on the neck of the water bottle so as to cover the opening 42. The cap housing 16 may be retained in place with a friction fit or with a variety of retaining levers that will clamp it in place and allow for its easy release. The necks of water bottles are typically round in cross section, such that the initial orientation of the cap housing 16 with respect to the water bottle is not a matter of concern. The user will simply rotate the housing cap 16, together with the water bottle 40, until the water delivery tube 20 is pointing toward the user at a position which will eventually allow it to extend through the housing 12.

The water bottle 40, with cap housing 16 in operative engagement on the neck thereof, is then lowered onto the cold saddle 44. The cold saddle 44 is in intimate supporting and thermal contact with the bottom of the water bottle 40. Preferably, the cold saddle is contoured to mate with the bottom and a selected portion of the sides of water bottle 40 in order to provide an optimum surface area in contact with the water bottle 40 to maximize cooling efficiency while the exposed surfaces remove further heat from the air contained within housing 12. The dispenser cap 17 will align itself in guide slot 46 as the water bottle 40 is moved rearwards. Finally, a power adapter on the back of dispenser cap 17 will mate with power receptacle 48 at the back of guide slot 46 as water bottle 40 settles into place.

Figure 3:
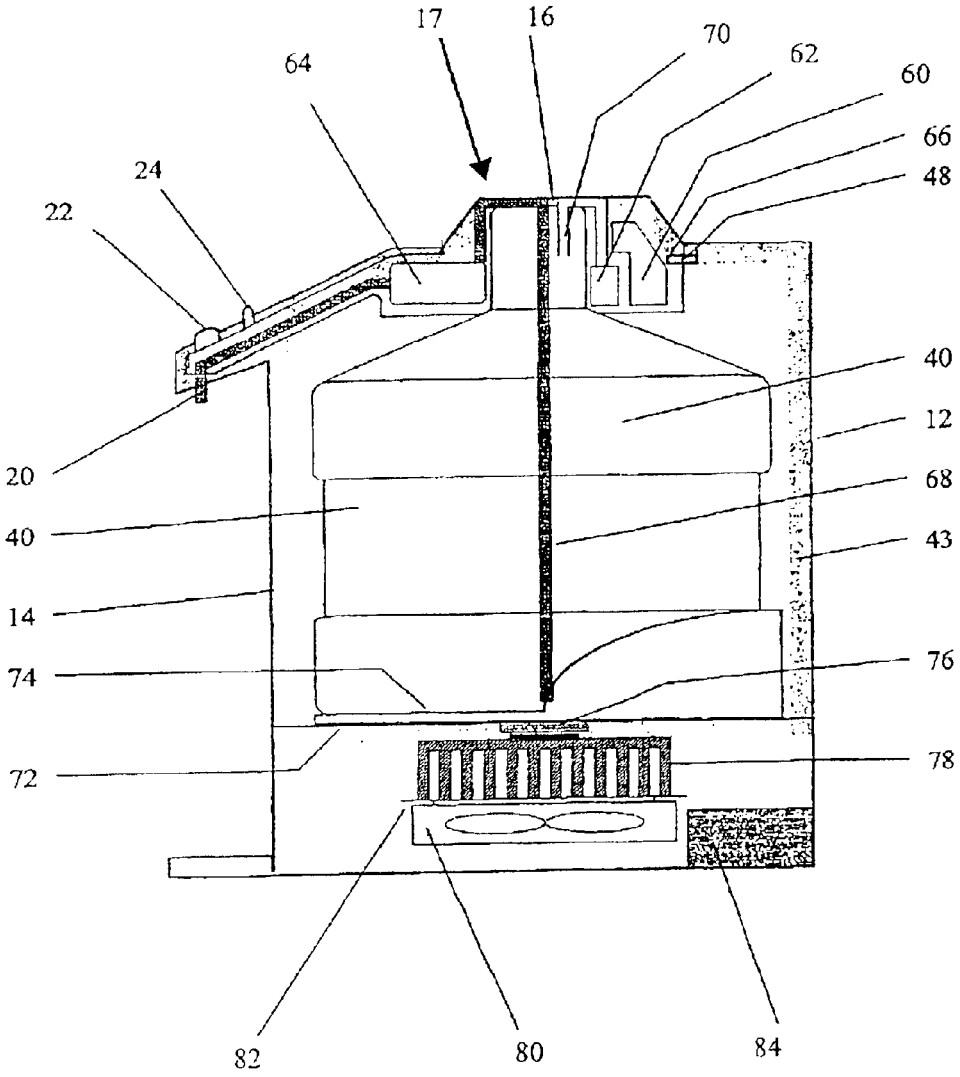
FIG. 3 is a vertical section of the cooler and dispenser taken along line A—A of FIG. 1.

Finally, the front cover 14 of the housing 12 is positioned around the front of water bottle 40, pushed into place, and retained by tabs 45 which may be accessed through pull recesses 26 (both sides). As can be seen in FIG. 3, the water delivery tube 20 is designed to extend through an opening in the front cover 14 of the housing 12, allowing water to dispensed outside the housing 12 through water delivery tube 20 without requiring any further water connections. In the preferred embodiment shown, the actuation means 22 and indicator light 24 also align with openings in the front cover 14 of the housing 12 so that they may be accessed from the outside of the water cooler and dispenser 10 without requiring any further wiring and/or electrical connections.

The front cover 14 is constructed to be relatively large so that it is easy to move water bottle 40 into and out of housing 12 by placing one hand on each side of the bottle. The removed front cover 14 also exposes a great deal of the interior of housing 12, thereby making it easy to keep the interior of the water cooler and dispenser 10 clean.

As shown in FIG. 3, the housing 12 is adapted to retainingly engage the dispenser cap 17, the cold saddle 44, and the water bottle 40. When in operative position supported on the cold saddle, the water bottle 40 is surrounded by insulated surfaces, The housing 12 is completely insulated, including front cover 14, and the insulated floor 72, all of which are coated on their surfaces with insulation 43. Even the cap housing 16 is can be coated on its inner surface with insulation. Essentially, the water bottle 40 is encased within insulation in a compartment that can be thermostatically controlled at a constant temperature with a minimum level of refrigeration. Accordingly, the entire water bottle 40 can be chilled, and this fact contributes to the overall efficiency of the water cooler. By contrast, conventional water coolers leave the water bottle exposed to the ambient air in the room in which the cooler is located. Such conventional coolers require greater amounts of energy in order to cool the water over a temperature gradient from room temperature to a desired chilled temperature, on demand as the water is dispensed.

The dispenser cap 17 contains within its cap housing 16, a power plug 66, a level indicator control circuit 60, an air filter 62, a pump 64, a water delivery tube 20, an indicator light 24, and an actuation means 22 As discussed previously, the water delivery tube 20, an indicator light 24, and an actuation means 22 each extend through at least one opening in the housing. The dispenser cap 17 fits snugly to operatively engaged the neck of the water bottle 40 such that any water pumped out by pump 64 through the water delivery tube 20 will create a vacuum within water bottle 40. This vacuum draws replacement air into the water bottle 40 through an air inlet. In the preferred embodiment shown, the air inlet is an air inlet tube 70 having a first end in fluid connection with the interior of the water bottle 40 and a second end to access the air within housing 12. An air filter 62 is attached to the second end of the air tube 70 to prevent unwanted airborne particles and possible contaminants from entering the water bottle 40 as air rushes in to replace the dispensed water.

The air filter 62 also acts as an air flow restricting means to ensure that the drawback vacuum persists in the water bottle 40 for a selected time after the actuation means 22 has been released and the pump 64 has stopped. Although only temporary in nature, this residual vacuum is sufficient to draw residual water from the delivery tube 20 back into the water bottle 40 rather than dripping from the front of the water delivery tube. It should be noted that this feature could also be achieved through other means of limiting the free flow of air back into water bottle 40, for example a small orifice placed in air tube 70, without the use of the filter. Nevertheless, the use of the air filter 62 is preferred since it has the additional advantage of lessening the risk of contaminating the water supply in the water bottle due to air borne contamination. Thus the air filter advantageously performs a dual function simultaneously.

The pump 64 is mounted within the cap housing 16 in fluid connection with the interior of the water bottle and with the delivery tube 20, which may be removed for easy cleaning. It is preferable to use an electric pump, although other pumping means may be employed. The fluid connection between the pump 64 and the interior of the water bottle 40 is preferably accomplished by means of a draw tube 68. The pump 64 draws water through the draw tube 68. The draw tube has a first end operatively attached to the pump 64 and a second end which depends within the interior of the water bottle 40. It is preferred that the draw tube 68 should reach to the bottom of the water bottle in order to draw the coldest water out of the bottle first and to drain Water Bottle 40 as completely as possible. The second end of the draw tube 68 is adapted to rest directly on the bottom of the bottle while still removing water from the bottle. This function can be accomplished by a number of means such as cutting the second end of the draw tube 68 on an oblique angle or perforating the draw tube 68 adjacent to its second end.

As mentioned above, the water bottle 40 is chilled through intimate contact with the cold saddle 74 on the bottom and partially on the side surfaces. This intimate contact is ensured by the cold saddle 74 geometry and surface characteristic which mates with that of the bottom and a portion of the sides of water bottle 40 over the contact surface. Intimate contact is further ensured by the weight of the water in water bottle 40 bearing down on the large horizontal surface of cold saddle 74.

The method whereby heat is removed from the water through cold saddle 74, utilizing a thermoelectric (TE) module 76, and dispersed from heat sink 78, as well as the method for gathering and dispersing the condensation that will form on the top of cold saddle 74 under certain conditions is known and is fully disclosed in U.S. Pat. No. 5,469,708 issued Nov. 28, 1995.

A fan 80 is positioned to create a flow of air that impinges directly on the bottom surface of heat sink 78 and exits at either end of heat sink 78. The housing has at least one and preferably two openings in the form of side vents 28 (see FIG. 1) as well as a rear opening to provide the necessary venting of the cold saddle 74. A baffle 82 contains the flow of air within the heat sink 78, maximizing the efficiency of the heat dispersion process. These components have been arranged to meet the thermal requirements as efficiently as possible while requiring a minimum of vertical height.

A power supply and control circuit 84 provides power directly to the fan 80 and the thermoelectric module 76, and indirectly to the pump 64 and the indicator light 24 through a power receptacle 48. The power receptacle 48 mates with a power plug 66 as the dispenser cap 17 operatively engaged to the neck of the water bottle 40 is placed in the housing 12, thereby connecting pump 64 and indicator light 24 to power supply and control circuit 84.

A thermostatic control within power supply and control circuit 84 supplies full or residual power to thermoelectric module 76 to keep the water temperature at the desired temperature as measured by a sensor which may be affixed to cold saddle 74. Residual power is used to prevent the reverse flow of heat through thermoelectric module 76 that would occur if power were completely removed. Fan 80 is left on constantly to keep the temperature of heat sink 78 as low as possible at all times, ensuring that it will be at close to ambient temperatures before each "full power" cycle.

Figure 4:
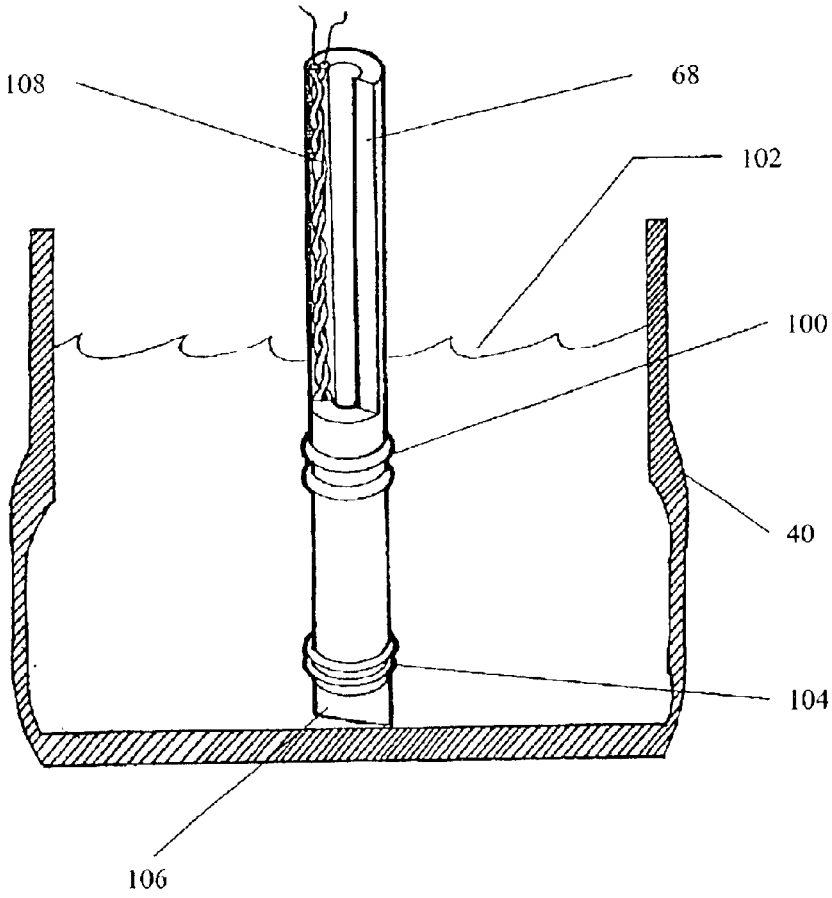
FIG. 4 is a detailed view of the draw tube, with a portion of the draw tube shown partially cut away.

FIG. 4 provides additional details regarding draw tube 68 and shows the location of fluid level sensors 100. These may be located near the bottom of water bottle 40 such that the user receives adequate warning that the water level is low prior to running dry. The fluid level sensors 100 may be constructed of Stainless Steel or any other non-corrosive and food safe electrically conductive material. The fluid level sensors 100 are connected to indicator light 24 (reference FIG. 1) such that indicator light 24 turns from green to red when water level 102 drops below fluid level sensors 100. The connections are achieved through lead wires 108 which run through the sidewall of water draw tube 68.

The bottom of the draw tube 68 may be cut on a slight oblique angle 106 to allow water to enter through the open side while the closed side rests on the bottom of the water bottle 40. A bellows 104 allows the draw tube 68 to adapt to slight differences in water bottle geometry. This arrangement allows as much water as possible to be drawn from each water bottle 40.

As an alternative to the bellows arrangement depicted in FIG. 4, draw tube 68 may be constructed with two interlocking sleeves, one of greater diameter than the other, to accommodate wider changes in bottle geometry. This design could be used to construct a draw tube 68 which is adaptable to both 3.0 and 5.0 gallon bottles.

Figure 5:
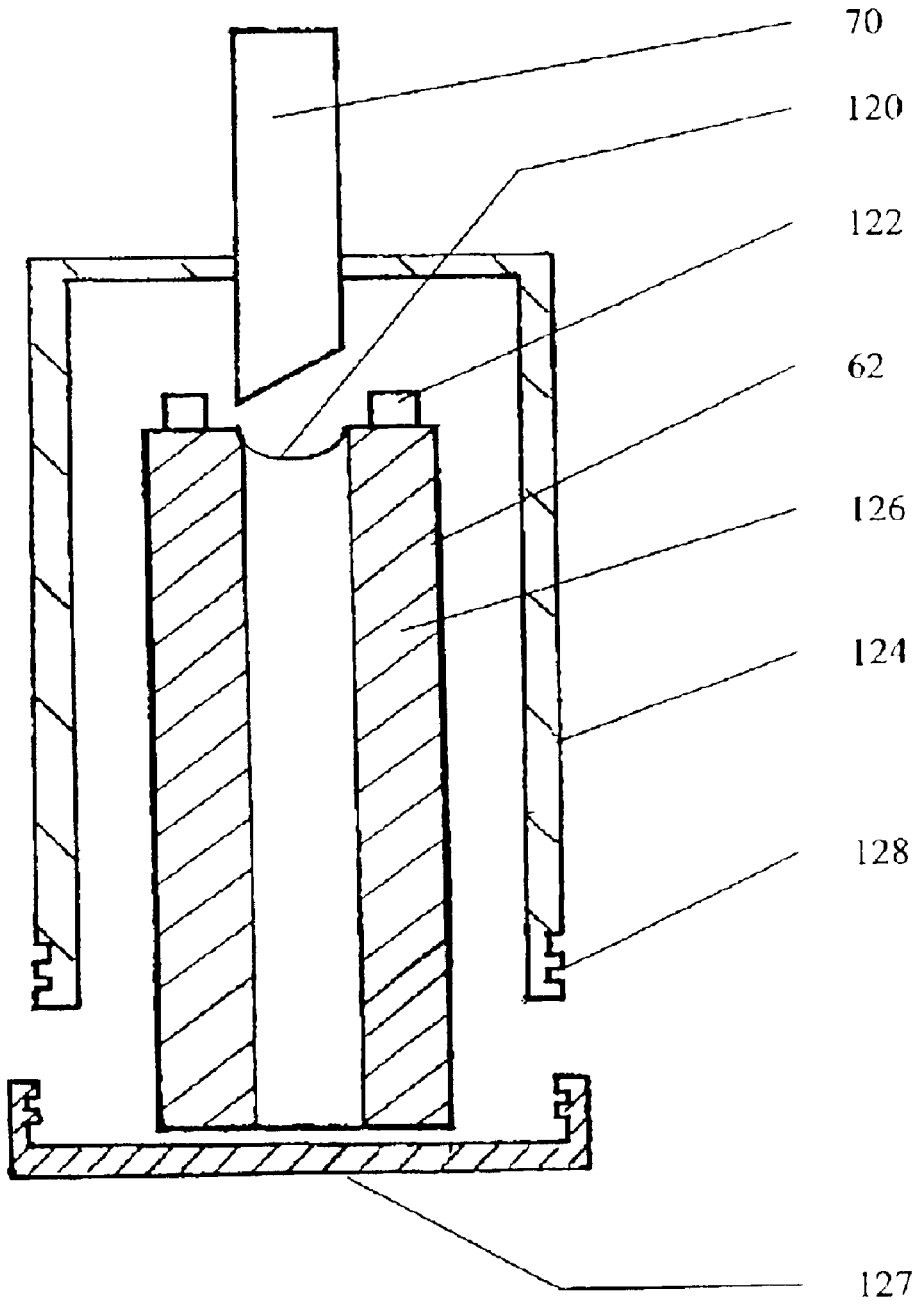
FIG. 5 is a detailed view of the air filter of FIG. 3.

FIG. 5 provides further detail regarding the air filter 62 and how the user may easily replace it. The air filter 62 is of standard design with an open centre channel surrounded by a typically paper element 126. A rubber diaphragm 120 is pierced by the oblique end of air tube 70 as air filter 62 is placed in canister 124. A canister lid 127 fits securely on canister 124 by twisting it over threads 128, and has vent holes to allow air to freely enter air filter 62. A rubber gasket 122 becomes compressed and surrounds rubber diaphragm 120 ensuring that air can only enter air tube 70 through paper element 126 once air filter 62 is securely in place. In this manner air filter 62 may be replaced as easily as a flashlight battery.

Figure 6:
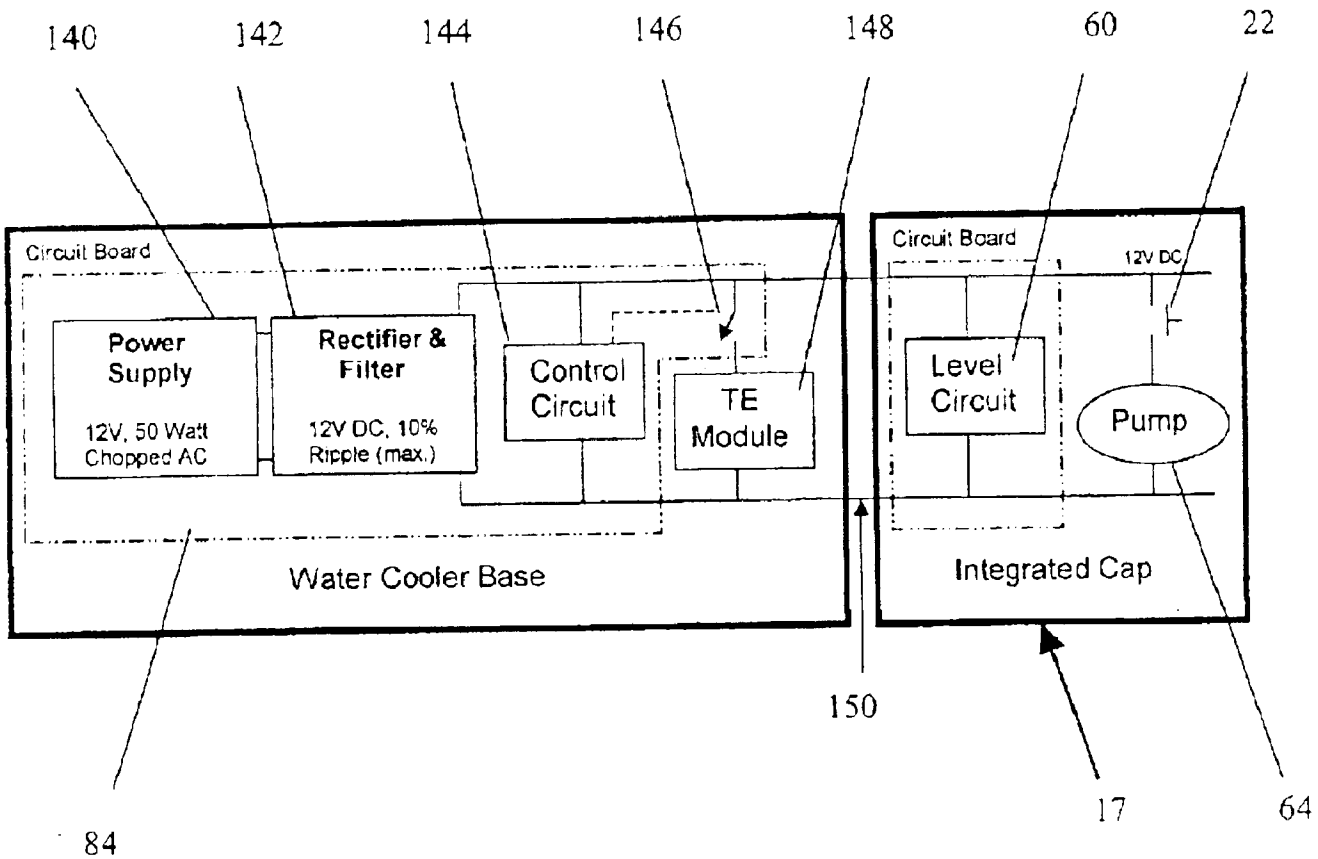
FIG. 6 is a schematic diagram of the circuit board of the water cooler and dispenser.

FIG. 6 presents an overview of the electrical connections within the water cooler and dispenser 10. The power supply and the control module 84, as it was presented in FIG. 3, includes a power supply 140, a rectifier and filter 142, and a control circuit 144. The power supply 140 supplies an AC voltage sufficient to allow the rectifier and the filter 142 to supply 12V DC, and may be based on switching technology or transformer technology. The rectifier and filter 142 converts this to 12V DC and supplies this voltage to the control circuit 144 and to the dispenser cap 17 through power plug connection 150 (consisting of power receptacle 48 and power plug 66 as presented in FIG. 3). The control circuit 144 controls control switch 146 which connects control circuit 144 to the TE module 148 only when additional cooling is required. In the preferred embodiment, control switch 146 will supply at least a residual voltage to the TE module 148 at all times and full voltage to the TE Module 148 when additional cooling is required in order to prevent the reverse flow of heat back through the TE Module 148 that would occur when no voltage is applied.

The dispenser cap 17 contains the control circuit 152 and the pump 64. The control circuit receives a full 12V DC when power plug connection 150 is connected (i.e. when dispenser cap 17 is in place in the water cooler). On the other hand, the pump 64 will only receive power when the user activates actuation means 22. The actuation means 22 is a momentary contact so that the pump 64 will be turned off as soon as the user releases the actuation means 22.

Figure 7:
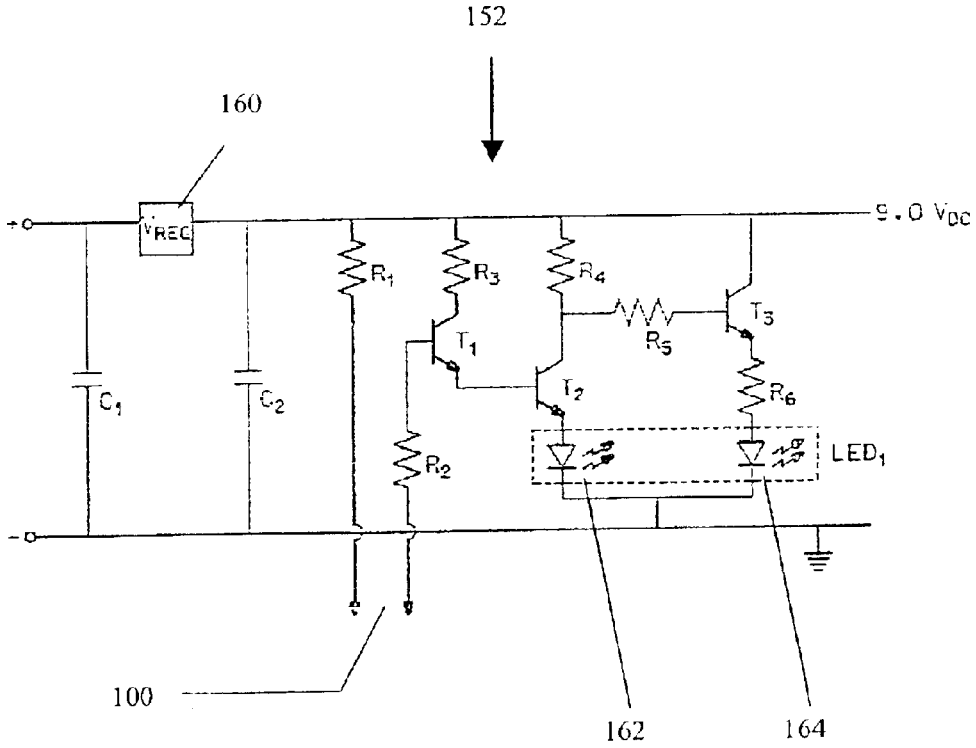
FIG. 7 is a circuit diagram of the control circuit for the level indicator contained within the dispenser cap.

FIG. 7 provides a circuit diagram for level indicator circuit 152. Power flows into the left side of the circuit and must first pass through voltage regulator 150 which removes the ripple, which may be as high as 10% on the incoming 12 volt DC. and supplies a smooth 9 volt DC to the remaining components in the circuit. The capacitors C1 and C2 act as filters to further improve the quality of the output from voltage regulator 150.

A small current flowing between fluid level sensors 100 will turn on transistor T1 which in turn will turn on transistor T2 serving to amplify the signal from fluid level sensors 100. The current flowing through fluid level sensors 100, and the voltage across fluid level sensors 100 when current is flowing, are both minimized and kept to safe levels by resistors R1 and R2. These resistors also limit the gate current presented to transistor T1.

After transistor T1 has turned on transistor T2, current will flow through resistor R4 and transistor T2 in order to illuminate the green filament 162 contained in LED1. Note that this increases the voltage across resistor R4, turning off Transistor T3 and preventing current from simultaneously flowing through red filament 164.

At such time as the water level in water bottle 40 (reference FIG. 3) falls below fluid level sensors 100, current will stop flowing between fluid level sensors 100. This will turn off transistor T1 which will then turn off transistor T2. The voltage across resistor R4 will then decrease, allowing a small current to flow through resistor R5 in order to turn on transistor T3. Current will then flow through resistor R6 and through red filament 164 in LED1. Note that transistor T1 has already been turned off, preventing current from simultaneously flowing through green filament 162.

Figure 8:
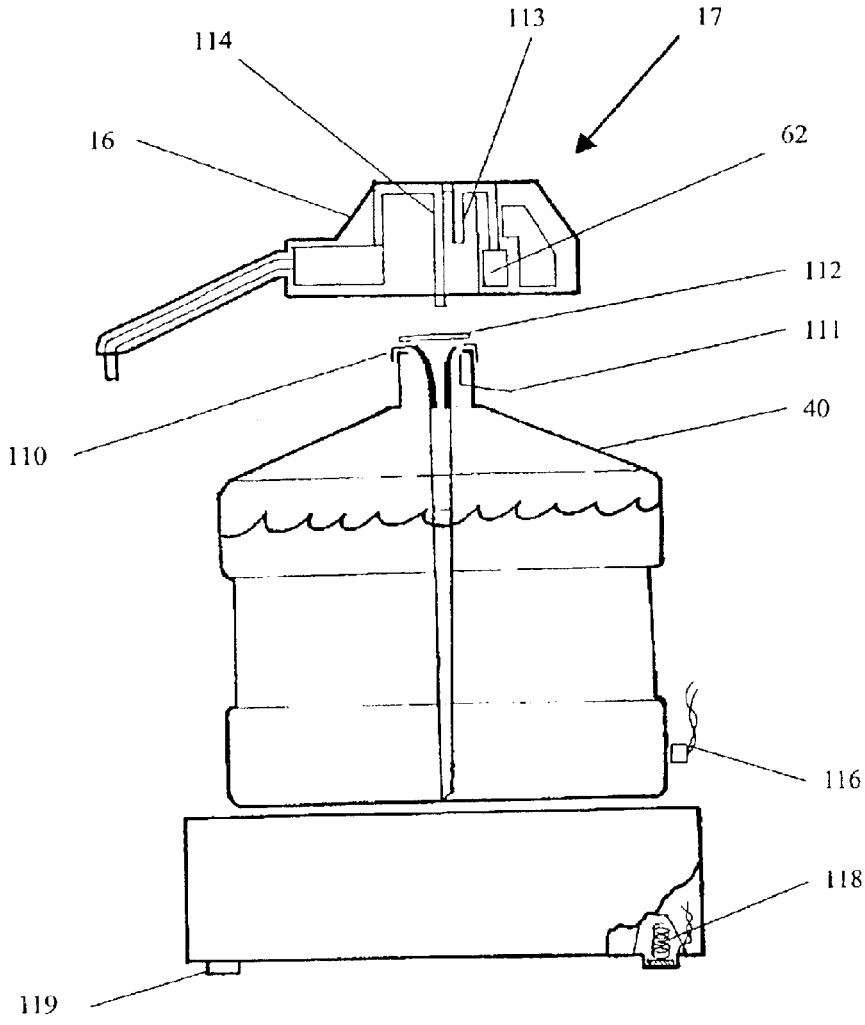
FIG. 8 is a sectional view of an alternative embodiment showing a sealed dispenser cap draw tube assembly having an interface with the dispenser cap.

An alternative embodiment recognizes that at some point in the future water bottlers may provide water bottles with sealing caps that include a water draw tube depending from the cap and into the water bottle as seen in FIG. 8. A sealing cap draw tube 110 can be placed over the neck of the bottle at the bottling plant. A further removable sanitary seal 112 can be placed over the hole in the middle of sealing cap draw tube 110, i.e. over the top of the exposed draw tube, and air intake hole 111. This approach may be better from a consumer perspective since it will provide a clean draw tube with each new bottle supplied.

The upper section of sealing cap draw tube 110 may be tapered to accept the short water draw tube adapter 114 that will extend down from the dispenser cap 17 when it is placed on water bottle 40. The mating surfaces will ensure a reasonably airtight fit, allowing water to be drawn from the bottom of water bottle 40. A sealing cap draw tube 110 may also be configured to stay in place as dispenser cap 17 is lowered into position, forming a reasonably airtight seal with dispenser cap 17.

In addition to the water connections described above, air supply tube 113 will mate with air intake hole 111 as dispenser cap 17 is placed on water bottle 40 or on sealing cap draw tube 110 if it is designed to be left in place as outlined above. Sealing cap draw tube 110 may be of sufficiently flexible material to ensure that air supply tube is self-sealing as it extends through air intake hole 111. The purpose of this configuration is to ensure that all air entering water bottle 40 must first pass through air filter 62.

Eventually the use of sealing cap draw tube 110 may be commonplace amongst water bottlers, however this change may take some time. In the interim, water draw tube adapter 114 may be supplied with an extension similar to water draw tube 68 as described in FIG. 4. This would allow the dispenser cap 17 to be used with all bottles, using an extension that can also be removed for easy cleaning, while making the system compatible with sealing cap draw tube 110 when it is used. Alternatively some water bottlers may elect to only supply water draw tube adapter 114 or to supply draw tube adapter 114 with a custom fitting (to mate with sealing cap draw tube 110) as a means to keep the system proprietary, preventing the use of a competitor's water bottles, and make it more difficult to refill water bottle 40. The use of sealing cap draw tube 110 also prevents the bottle from being used on "traditional" coolers where the bottle must be inverted since water can no longer leave the bottle at the neck when the bottle is inverted.

One disadvantage of sealing cap draw tube 110 is that it does not contain the level sensors, and different level sensing techniques will be required. Capacitive sensor 116 may be placed in close proximity to the side of water bottle 40 such that it "reads through" the side of water bottle 40 and detects the presence or absence of water. Alternatively, a small strain gauge sensor foot 118 may be built into one of the housing feet such that the full load of water bottle 40 and water will compress the spring and cause a contact to be activated. The reduced load of water bottle 40 as the water level drops will allow the spring to rise, causing the contact to be de-activated. This signal can be used to control level indicator 24 (refer to FIG. 3). Note that strain gauge sensor 118 may be a single rear toot combined with two (2) front feet 119. The resulting triangle platform will be steady on a variety of surfaces, and the user will not notice the slight lift in strain gauge sensor foot 118 as the water level drops.

The cooler and dispenser of the present invention is readily adaptable to a variety of configurations. For example, in situations where the device is not intended to fit into a height restricted area, such as a counter top underneath kitchen cupboards, the cooler and dispenser could be modified to have a cabinet which can stand freely on the floor. Additionally, where height is not a limiting factor, the insulated housing can be manufactured in a larger form to store a spare bottle of water in a chilled state ready for use as soon as the water supply in the current bottle is been exhausted.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

We claim:

1. A cooler and dispenser for use with a water bottle, comprising in combination:

a dispenser cap, further comprising, a cap housing adapted to operatively engage a neck of the water battle; a pump mounted within the cap housing in fluid connection with the interior or the water bottle and with a delivery tube; an air inlet tube having a first end in fluid connection with the interior of the bottle and a second end in fluid connection with the air, and an air filter operatively connected to the second end of the air inlet tube:

an actuating means operatively connected to the pump to selectively operate the pump to draw water from the water bottle into the delivery tube;

a thermally conductive cold saddle configured for intimate supporting contact with the water bottle and to withdraw heat from the water contained within the water bottle; and, a housing to retainingly engage the dispenser cap, the cold saddle, and the water bottle, said housing having at least one opening to permit the extension of the delivery tube therethrough, the extension of the actuating means therethrough the venting of the heat from the cold saddle, and the through passage of an electrical power supply to the cold saddle and the pump.

2. The water cooler and dispenser of claim 1 further comprising an indicator, visible through an opening in the housing, said indicator light being operatively connected to a control circuit, which control circuit is operatively connected to a water level sensor, whereby the indicator emits a first signal when power is applied to the cooler and dispenser, and a second signal when the fluid level in the water bottle falls below the threshold level.

3. The water cooler and dispenser 2 wherein the fluid level sensor is a strain gauge.

4. The water cooler and dispenser 2 wherein the fluid level sensor is a capacitance device.

5. The water cooler and dispenser 1 wherein the cold saddle is contoured to mate with the bottom and a selected portion of the sides of water bottle.

6. The water cooler and dispenser 1 wherein the housing is insulated.

7. A dispenser cap for use with a bottle, said dispenser cap comprising:

a cap housing adapted to operatively engage a neck of the bottle a pump mounted within the cap housing in fluid connection with the interior of the bottle and with a delivery tube an air inlet means in fluid connection with the interior of the bottle and with the air, Wherein the air inlet means is a tube having a first end in fluid connection with the interior of the bottle and a second end in fluid communication with ambient air, and wherein the second end of the air inlet means further comprises an air restricting means to ensure that a drawback vacuum persists in the bottle for a selected time after the pump has stopped, to draw residual fluid from the delivery tube back into the bottle.

8. The dispenser cap of claim 7 wherein the pump is an electric pump which may be selectively actuated to operate, thereby creating a vacuum within the bottle as fluid is pumped out of the bottle and through the delivery tube.

9. The dispenser cap of claim 7 wherein the air flow restricting means is an air filter operatively connected to the second end of the air inlet.

10. The dispenser cap of claim 9 wherein the air filter is configured such that substantially all air entering the bottle in response to a vacuum in the bottle must first pass through the air filter.

11. The dispenser cap of claim 10, wherein the air filter is adapted for easy removal and replacement.

12. The dispenser cap of claim 7 wherein the fluid connection between the pump and the interior of the bottle is through a draw tube having a first end operatively attached to the pump and a second end depending into the interior of the bottle.

13. The dispenser cap of claim 12 wherein the first end of the draw tube is removably attached to the pump, and wherein the second end of the draw tube is adapted to rest directly on the bottom of the bottle while still removing water from the bottle.

14. The dispenser cap of claim 12 wherein the draw tube is adapted with a bellows, and wherein the second end of the draw tube is adapted to rest directly on the bottom of the bottle while still removing fluid from the bottle.

15. The dispenser cap of claim 7 further comprising a fluid level indicator light having sensors located on the draw tube at a level corresponding to a threshold level of fluid within the bottle to detect threshold level of fluid within the bottle.

16. The dispenser cap of claim 15 wherein the sensors comprise an electrical circuit operating by means of the conductance of a small and harmless amount of electricity through the fluid, to detect the presence or absence of fluid at the threshold level.

17. The dispenser cap of claim 15, further comprising a control circuit connected to the level sensor and to an indicator means to signal when the fluid level in the bottle falls below the threshold level.

18. The dispenser cap of claim 17 wherein the indicator means is operatively connected to the control circuit, to emit a first signal when electrical power is applied to the dispenser cap, and a second signal when the fluid level in the fluid bottle falls below the threshold level.

19. The dispenser cap of claim 7 wherein the fluid connection between the pump and the interior of the bottle is by means of a draw tube adapter having a first end attached to the pump and a second end adapted for mating connection to a second draw tube having a top end attached to the bottle and a bottom end depending within the bottle.

* * * * *